US006234814B1

(12) United States Patent
Hirschmann

(10) Patent No.: US 6,234,814 B1
(45) Date of Patent: May 22, 2001

(54) ELECTRICAL CONNECTOR

(75) Inventor: Michael Hirschmann, Güglingen (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/388,543

(22) Filed: Sep. 2, 1999

(30) Foreign Application Priority Data

Sep. 5, 1998 (DE) ..... 198 40 648

(51) Int. Cl.[7] ..... H01R 29/00
(52) U.S. Cl. ..... 439/188
(58) Field of Search ..... 439/188, 352, 439/488, 489; 200/51.1

(56) References Cited

U.S. PATENT DOCUMENTS 5,613,865 * 3/1997 Dullin et al. ..... 439/188
5,647,757 * 7/1997 Chrysostomou ..... 439/352
5,702,265 * 12/1997 Yamaguchi ..... 439/352
5,720,623 * 2/1998 Polenick et al. ..... 439/352
5,746,618 * 5/1998 Gauker ..... 439/352
5,924,885 * 7/1999 Pacher ..... 439/352
5,993,230 * 11/1999 Gauker et al. ..... 439/188
5,997,334 * 12/1999 Goto ..... 439/352

FOREIGN PATENT DOCUMENTS 195 13 358 8/1996 (DE) ..... H01R/13/639
0 591 948 4/1994 (EP) ..... H01R/13/639

* cited by examiner

*Primary Examiner*—Lincoln Donovan
*Assistant Examiner*—Thanh-Tam Le
(74) *Attorney, Agent, or Firm*—Blank Rome Comisky & McCauley, LLP

(57) ABSTRACT

An electrical connector for connecting to a receptacle or squib coupled to an electrical control for a vehicle restraint system such as an air bag. The connector has a housing (12) having a plugging portion (14) facing the receptacle (60). The plugging portion (64) of the receptacle has a shorting bar (50) which is guided resiliently and is situated against the contact pins (44, 46) when the housing is unplugged from the receptacle. The shorting bar has resilient arms on both sides, extending from its portion contacting the contact pins, which serve as support surfaces for the locking member.

5 Claims, 2 Drawing Sheets

ELECTRICAL CONNECTOR

SPECIFICATION

Figure 2:
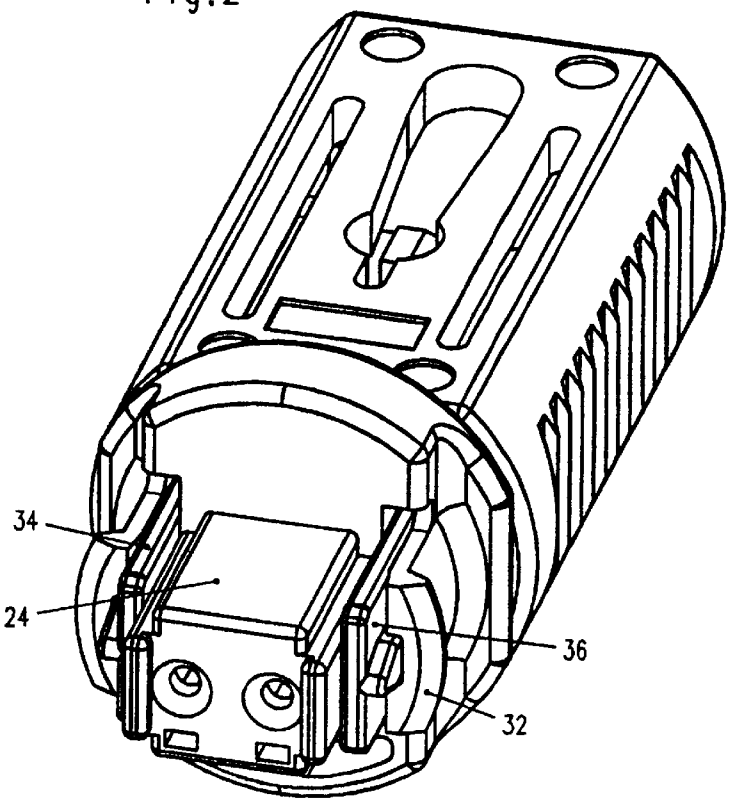

The invention concerns an electrical connector, in particular for a connection between a receptacle (squib) and an electrical control for restraint systems in motor vehicles, for example air bags.

Such a connector is known from DE 195 13 358 C2. It comprises a housing for receiving electrical cables as well as contact springs connected thereto, the contact springs serving for receiving contact pins of the associated receptacle. Furthermore, catching means for securing the housing to the receptacle as well as a locking member are provided, which secures the catching means against an accidental detachment after being inserted into a corresponding opening of the housing. According to the patent mentioned above, the locking member is formed as a sleeve which is disposed coaxially with the housing and can be displaced axially on the housing.

Often, connectors of said type which serve for connecting an air bag in vehicles, for example, are coded to avoid a wrong connection. For that purpose, the connectors have an asymmetric structure. Accordingly, the contact pins of the receptacle can only be guided into the contact springs on the housing, if they are aligned in a special way.

If such a connector is used for a side air bag, for example, problems may result inasmuch as the associated receptacle has to be put-on in a position offset by 180° on both sides. Corresponding problems of the connections result therefrom.

In the known connector, the locking member has an essentially U-shaped cross section, the connecting leg being elongated with respect to the side legs, in order to remove a shorting bar being effective between the contact pins of the receptacle in pushing-on the locking member.

It is clearly obvious that said connector can only be fabricated with a specific alignment.

It is an object of the invention to provide a connector of the mentioned type, which enables the contact springs and the contact pins to contact, even if the parts are to be mounted offset by 180° with respect to each other.

Starting out from an electrical connector, in particular for a connection between a receptacle (squib) and an electrical control for restraint systems in motor vehicles, having the following features:

a housing having a plugging portion facing the receptacle, whereby contact springs are disposed in the plugging portion of the housing, and first catching means are provided on the plugging portion of the housing for catching corresponding second catching means being formed on a plugging portion of the receptacle, and the plugging portion of the receptacle has a number of contact pins corresponding to the number of contact springs, wherein a locking member is provided on the plugging portion between the contact springs and the first catching means, which secures the catching means against an accidental detachment in the plugged condition of the housing and the receptacle and after being displaced axially, the invention is characterized by the following three structural features:

1. the plugging portions of the housing and the receptacle correspond to each other and each has an axial-symmetric shape, 2. the locking member extends in a plane prependicular to a plane in which the contact springs and the contact pins are situated,
3. the plugging portion of the receptacle has a shorting bar guided resiliently, which is situated against the contact pins in the unplugged condition of the housing and the receptacle and which can be removed from the contact pins by the locking member in the plugged condition of the housing and the receptacle, when the locking member is moved to its locking position.

Here, a first essential feature is the symmetric structure of the corresponding plugging portions of the housing and the receptacle. First, it becomes possible thereby to bring the contact springs of the housing into contact with the contact pins of the receptacle in a first position as well as a second position offset by 180°, as it is known from conventional house sockets and associated plugs.

However, said symmetric structure of the plugging portions alone does not provide a solution for the object of the invention, because it has to be taken into consideration to adapt the other components so that the function of the locking member is preserved and the shorting bar can be removed when both parts are exactly in engagement with each other.

Because of that the locking member is to be placed in a plane perpendicular to a plane in which the contact springs and the contact pins are situated.

It that manner it is possible to provide the shorting spring with corresponding resilient arms being then situated in the path of the locking member that is outside the actual contact zone.

Accordingly, the shorting spring has a shape in accordance with the third feature mentioned above.

Usually, the locking member has two locking arms being spaced apart and extending in parallel, according to the condition of an axial-symmetric shape.

Accordingly, it is sufficient to form the shorting spring in such a manner that a portion of it is situated in the path of displacement of a locking arm. Even in bringing the contact pins to the spring contacts in a manner offset by 180°, the (other) locking arm will then charge the respective portion of the shorting spring to move the shorting spring out of the shorting position.

But in this embodiment a distortion of the shorting spring may occur, because of which another embodiment is proposed, wherein the shorting spring has resilient arms on both sides starting from the portion contacting the contact pins, which serve as leading surfaces for the locking member.

In this way, a symmetric distribution of force by the locking arms onto both resilient arms is always provided and a simultaneous and uniform removal of the shorting bar from both contact pins is obtained thereby—regardless of the plugging position of the receptacle.

In order to prevent a torsion of the shorting spring during its mechanical actuation, an embodiment provides for resilient arms of the shorting spring being connected by a web being separated from that portion of the contact spring contacting the contact pins.

In this sense, an embodiment wherein the resilient arms of the shorting spring have a conical geometry is also of advantage.

Altogether, a relatively simple structure of the connector results, which enables the mutual components to contact and catch reliably. Two plugging positions (offset by 180°) are possible for attaching the connector part to the squib. An inclined or turned plugging is prevented by the corresponding shape of the plugging portions of the housing and the receptacle. Also, the shorting spring is still active in the final contact position and engagement of the two components. Only when the locking member is brought to its end position, a secondary securing of the catching elements (secondary locking) on one hand and a removal of the shorting position of the shorting spring on the other hand are effected by the shorting spring being moved away from the contact pins of the squib. Experience shows that a short distance of displacement is sufficient, which can be less than 1 mm.

Further characteristics of the invention follow from the features of the subclaims as well as the other description documents.

In the following, the invention will be explained in more detail with an embodiment.

Figure 1:
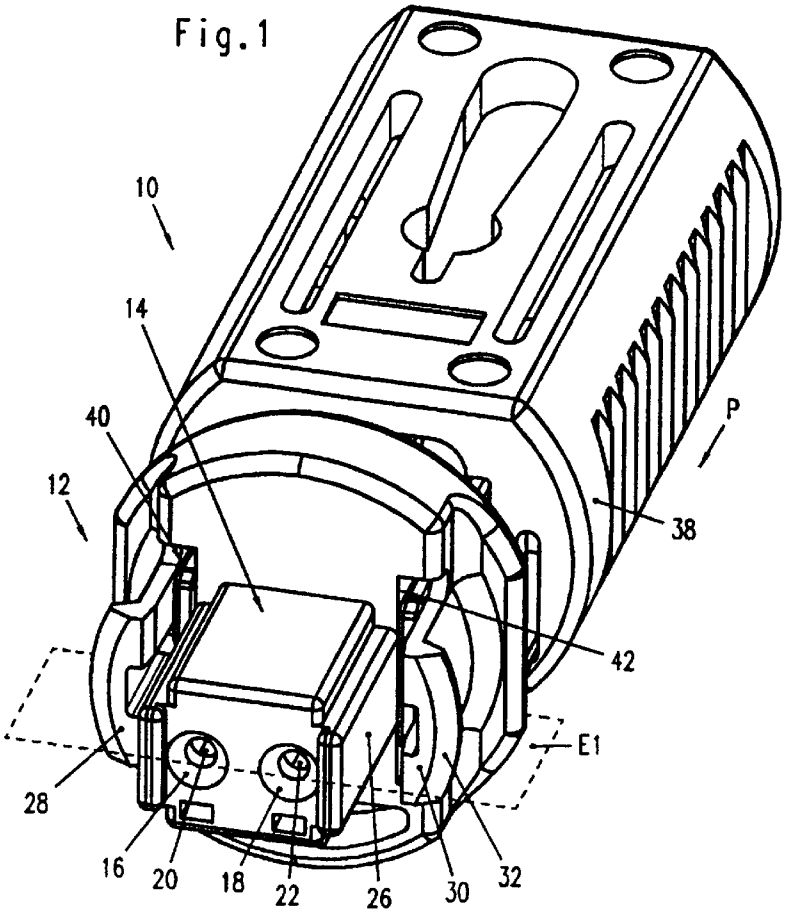
Figure 5:
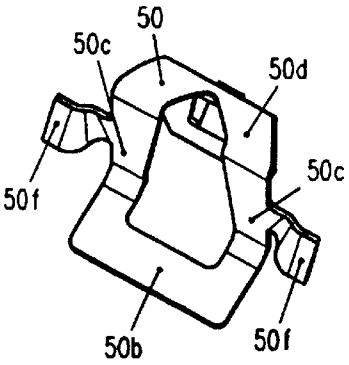
Figure 4:
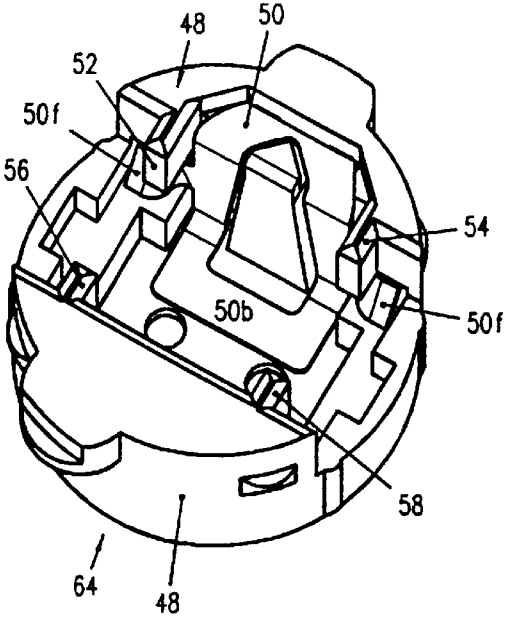
Figure 3:
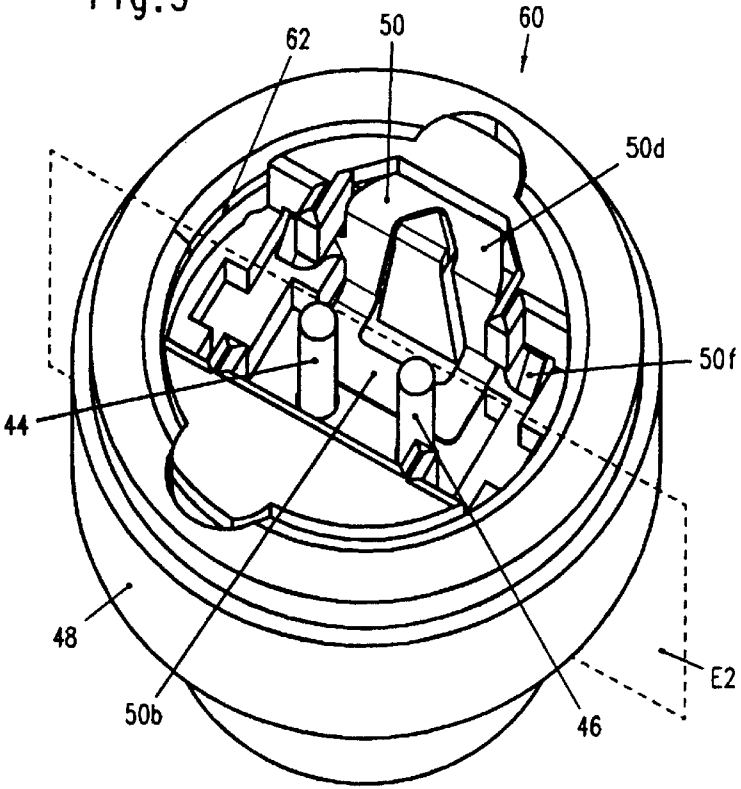

The figures show—each in schematic representation:

FIG. 1 a perspective view of a connector having a locking member in a drawn-back position, FIG. 2 a view corresponding to FIG. 1, wherein the locking member is in the locking position, FIG. 3 a perspective view of an associated receptacle, FIG. 4 a perspective view of the insulating body of the receptacle with a shorting spring being inserted, FIG. 5 a perspective view of the shorting spring according to FIG. 3, 4.

FIG. 1 shows a connector 10 having a housing 12, which has a plugging portion 14 facing a receptacle (FIG. 3 to 5).

Two reception openings can be seen in the plugging portion 14, to which contact springs 20, 22 are joined, being disposed in a plane E1.

The contact springs 20, 22 are situated in a box-like element 24 comprising upper and lower limiting surfaces in parallel with the plane E1 and side walls extending perpendicularly thereto, one side wall being indicated by the reference number 26.

The plugging portion 14 comprises catching arms 28, 30 spaced apart from and in parallel with the side walls 26, having curved detents 32 projecting outwardly on one side.

In each gap between the side walls 26 and the catching arms 28, 30 an arm 34, 36 of a locking member 38 is disposed, which passes through corresponding recesses 40, 42, when it is moved in the direction of arrow P towards the plugging portion 14 (FIG. 2).

As shown in FIGS. 1 and 2, all components of the plugging portion 14 have an axial-symmetric structure.

This is also true for the receptacle 60 illustrated in FIGS. 3 to 5, which comprises contact pins 44, 46 in its plugging portion 64, which extend in a plane E2 and pierce an insulating body 48 having a configuration around the contact pins 44, 46, which corresponds to the plugging portion 14 of the connector 10.

The position and configuration of a shorting spring 50 which is illustrated in detail in FIG. 5 is of particular interest.

It comprises a base leg 50*b* lying against the contact pins 44, 46 in the unplugged condition of the receptacle 60 and the connector 10. Two side webs 50*c* extend upwardly, bent at about 90°, from the base leg 50*b*, joining a connecting web 50*d* being bent twice with respect to the side webs 50*c* and being inserted into the insulating body 48.

Resilient arms 50*f* extend outwardly from the sidewalls of the connecting webs 50*c*, which are bent forwardly (towards the base leg 50*b*) and have a conic shape, respectively.

As shown in FIGS. 3 and 4, the resilient arms 50*f* reach below webs 52, 54 of the insulating body 48, projecting towards the contact pins 44, 46, corresponding webs 56, 58 being formed on the other side of the contact pins 44, 46.

In assembling the receptacle 60 and the connector 10, the side walls 26 of the plugging portion 14 are situated between corresponding webs 52, 56; 54, 58 of the receptacle 60, while the contact pins 44, 46 "enter" the openings 16, 18 and thus the contact springs 20, 22, that is irrespective of the parts being assembled in the regular position or offset by 180°.

In bringing the parts 10, 60 together, the catching arms 28, 30 catch in corresponding catching recesses 62 of the receptacle 60. Now, the receptacle 60 and the connector 10 have reached their end position.

But the shorting pin 50 is still in the shorting position.

If the locking member 38 is now moved from the position according to FIG. 1 to the position according to FIG. 2, not only a secondary locking of the catching arms 28, 30 is achieved thereby but also the following:

The front ends of the arms 34, 36 of the locking member 38 run against the resilient arms 50*f* of the shorting spring 50, just before the locking member 38 has reached its end position. The shorting spring 50 is tilted thereby in such a manner that the base leg 50*b* is moved away from the contact pins 44, 46.

The arms 34, 36 of the locking member 38 are disposed perpendicularly to the planes E1, E2 being in alignment and extend at the outside beside the webs 52, 56; 54, 58 which can be seen in FIG. 4.

The processes in plugging the components are identical, if the receptacle 60 is put onto the connector 10 in a position offset by 180°.

What is claimed is:

1. An electrical connector, in particular for a connection between a receptacle and an electrical control for restraint systems in motor vehicles, having the following features:

1.1 a housing having a plugging portion facing the receptacle, 1.2 contact springs are disposed in the plugging portion of the housing, and 1.3 first catching means are provided on the plugging portion of the housing for catching corresponding second catching means being formed on a plugging portion of the receptacle, 1.4 the plugging portion of the receptacle has a number of contact pins corresponding to the number of contact springs, 1.5 a locking member is provided on the plugging portion of the housing between the contact springs and the first catching means, which secures the catching means against an accidental detachment in the plugged condition of the housing and the receptacle and after being displaced axially, characterized in that 1.6 the plugging portions of the housing and the receptacle correspond to each other and each has an axial-symmetric shape, 1.7 the locking member extends in a plane perpendicular to a plane in which the contact springs and the contact pins are situated, and 1.8 the plugging portion of the receptacle has a shorting bar guided resiliently, which is situated against the contact pins in the unplugged condition of the housing and the receptacle and which can be removed from the contact pins by the locking member in the plugged condition of the housing and the receptacle, when the locking member is moved to its locking position, 2.0 wherein the shorting bar has resilient arms on both sides, extending from its portion contacting the contact pins, which serve as support surfaces for the locking member.

2. The connector according to claim 1, wherein the locking member (38) comprises two locking arms (34, 36) guided in parallel and having same shape and length.

3. The connector according to claim 1, wherein the resilient arms **(50*f*) of the shorting bar (50)** have a conical geometry.

4. The connector according to claim 1, wherein the resilient arms **(50*f*) of the shorting bar (50) are connected by a web (50*d*) being separated from that portion (50*b*) of the contact bar (50) contacting the contact pins (44, 46)**.

5. The connector according to claim 1, wherein the shorting bar (50) is guided at its end opposite the contact portion **(50*b*) on one side in an insulating housing (48)**.

* * * * *